United States Patent [19]

Veale

[11] 4,239,401

[45] Dec. 16, 1980

[54] IMPACT PRINTER HAMMER ASSEMBLY

[75] Inventor: John R. Veale, Manhattan Beach, Calif.

[73] Assignee: Plessey Peripheral Systems, Irvine, Calif.

[21] Appl. No.: 956,736

[22] Filed: Nov. 1, 1978

[51] Int. Cl.[3] ..... B41J 1/08; B41J 9/00

[52] U.S. Cl. ..... 400/144.2; 335/262; 335/263; 101/93.02; 101/93.34; 101/93.48

[58] Field of Search ..... 400/144.2, 144.3, 144.1, 400/144, 124; 101/93.48, 93.19, 93.02, 93.34; 335/263, 262, 281, 255–258

[56] References Cited

U.S. PATENT DOCUMENTS

| | | | |
|---|---|---|---|
| 2,531,500 | 11/1950 | Claytor | 335/263 X |
| 2,651,744 | 9/1953 | Acklin et al. | 335/262 X |
| 3,900,094 | 8/1975 | Larsen et al. | 400/124 |
| 4,016,965 | 4/1977 | Wirth et al. | 400/124 |
| 4,034,841 | 7/1977 | Ohyama et al. | 400/124 |
| 4,149,132 | 4/1979 | Richter et al. | 335/262 |

FOREIGN PATENT DOCUMENTS

| | | | |
|---|---|---|---|
| 2158263 | 5/1972 | Fed. Rep. of Germany | 400/144.2 |
| 2112799 | 10/1972 | Fed. Rep. of Germany | 335/262 |

*Primary Examiner*—E. H. Eickholt

*Attorney, Agent, or Firm*—Knobbe, Martens, Olson, Hubbard & Bear

[57] ABSTRACT

In a solenoid driven hammer for an impact printer, the armature, which is driven by the magnetic field provided by the solenoid's coil, is integral with the hammer which strikes a printing element on a print wheel. The shape of the pole piece in the solenoid conforms to the shape of the leading surface of the armature to provide a magnetic force field that is of constant strength as the armature is propelled toward the pole piece when the solenoid coil is energized. The hammer, being unitary with the armature, is thereby propelled against the printing element. As the hammer rebounds after striking the printing element, the armature strikes a polyurethane cushion which absorbs substantially all of the energy of the armature/hammer unit, thereby bringing the unit to a complete stop so that the next stroke may be quickly commenced.

10 Claims, 4 Drawing Figures

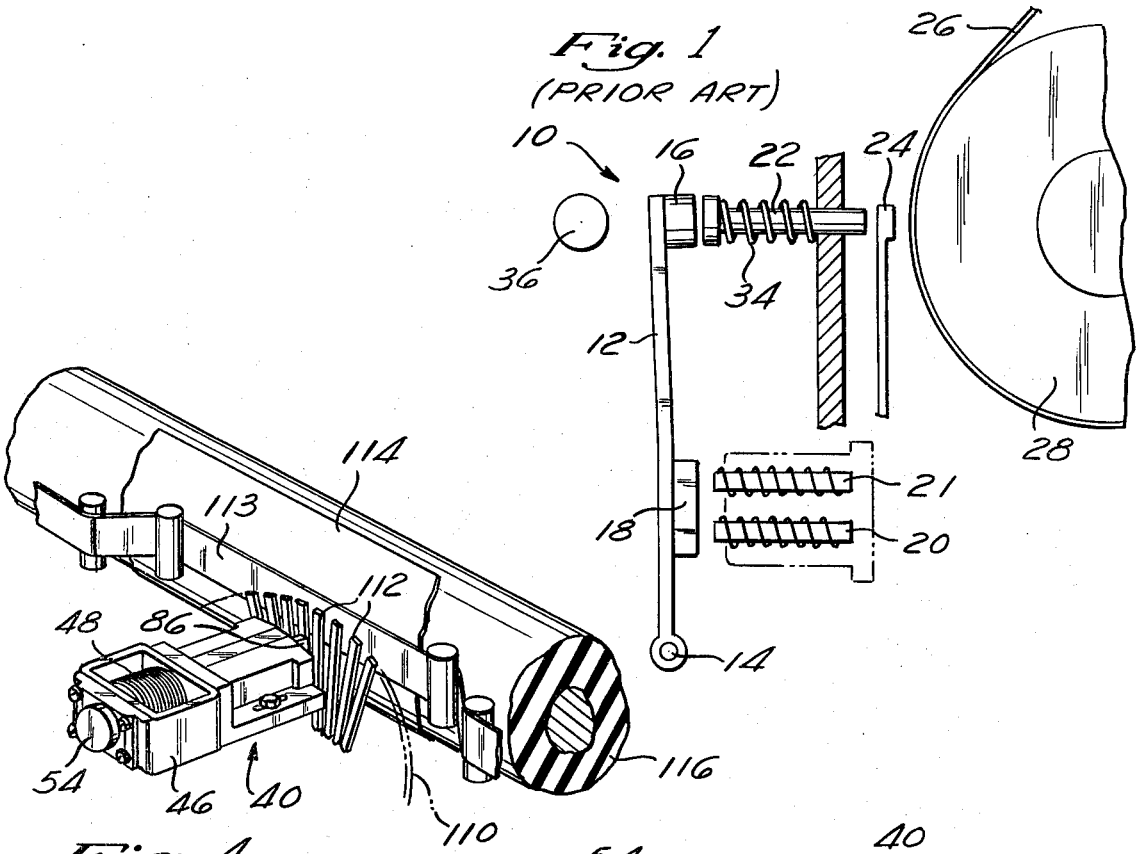
Fig. 1
(PRIOR ART)
Fig. 4
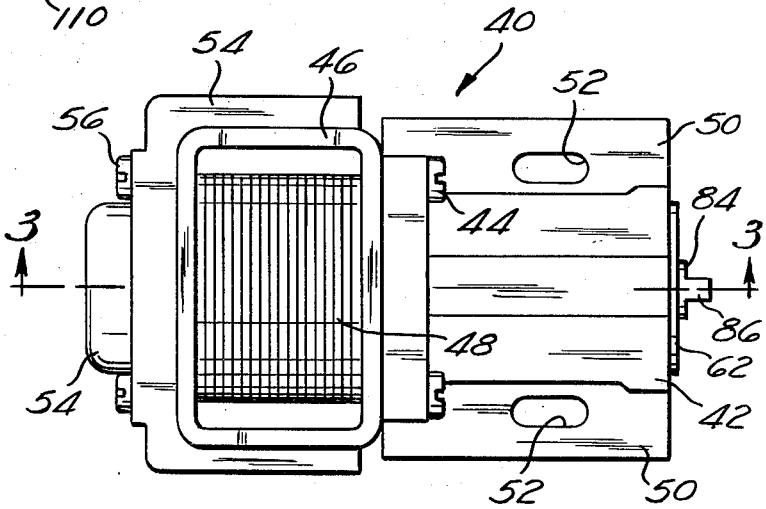
Fig. 2
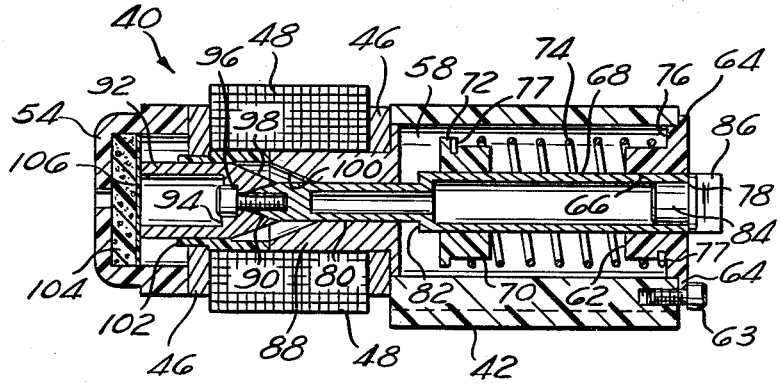
Fig. 3

IMPACT PRINTER HAMMER ASSEMBLY

BACKGROUND OF THE INVENTION

This invention relates to the field of high-speed mechanical impact printers, and in particular, it relates to an electromagnetically actuated hammer mechanism used to strike the printing elements in such printers.

The advent of high speed data processing and word processing equipment has brought about a need for high-speed printers capable of producing high quality printing. Perhaps the most popular type of printer in such applications is that which uses the so-called "daisy wheel". The daisy wheel basically consists of a disc having a plurality of flexible fingers or petals around its periphery, each of which bears a particular print character. In operation, a daisy wheel is rotated until the selected character is in position for printing, at which time a clapper is electromagnetically driven against a hammer, which in turn drives the print element against the paper to be printed. A typical example of such a printer is disclosed in U.S. Pat. No. 3,954,163 to Gabor.

In such printers it is necessary to have a significant clearance space between the hammer and the print wheel or daisy wheel when the hammer is withdrawn so that the print wheel may rotate freely without danger of striking the hammer and damaging the relatively fragile spokes or petals of the daisy wheel. Accordingly, the hammer must have a relatively long stroke so that it can be withdrawn a significant distance away from the print wheel as the print wheel rotates, while being capable of driving the printing element against the paper to be printed when the print wheel has stopped. The obvious approach to achieving such a long hammer stroke would be to propell the hammer by a strong magnetic field provided by a relatively large solenoid. However, in such printers, in order to achieve high speed, it has been found necessary to move the hammer assembly and print wheel across the platen by means of a servo-driven motor. Accordingly, it is desirable to keep the hammer assembly as light in weight as possible, thereby effectively precluding the use of the large, heavy solenoid which would be necessary to effect the required length of hammer stroke. Consequently, in order to make use of relatively small, lightweight electromagnetic coils, the typical prior art daisy wheel printer uses the coils to drive a relatively long clapper arm, much like that used in an electric doorbell. The end of the clapper arm travels in a relatively wide arch to strike the hammer, thereby allowing the hammer to have the necessary long stroke while using coils which are relatively small and lightweight.

Such a hammer assembly has several drawbacks. The first, of course, is complexity, which affects reliability. More importantly, the driving of the hammer indirectly through a second driven element, i.e., the clapper, limits the ability to control the impact force of the hammer against the print element.

SUMMARY OF THE INVENTION

The present invention overcomes the aforementioned problems by providing a solenoid which has a specially designed pole piece and armature. The armature is formed with a tapered leading surface, which is essentially in the shape of a truncated right frusticone. The pole piece is formed with a recess which conforms to the shape of the armature's leading surface. This configuration of the armature and pole piece provides for a magnetic force field having essentially parallel lines of force between the armature and the pole piece so that the magnetic force between the armature and the pole piece is substantially constant as the armature moves toward the pole piece. The advantages of such a force field are twofold: (1) The force on the armature being constant, regardless of the distance from the pole piece, the acceleration of the armature is constant; and (2) Since the lines of force do not diverge as distance from the pole piece increases, the initial position of the armature can be a significant distance from the pole piece and still be within an area of substantial magnetic field strength, thereby not only allowing the armature to be propelled toward the pole piece for a relatively long distance, but also allowing the rebound of the hammer to be precisely controlled by means of the magnetic field. This configuration thus allows the armature to be made unitary with the hammer, so that the hammer can travel with the necessary length of stroke without the need of the clapper. Not only is the mechanism of the present invention greatly simplified over that of the prior art, but the elimination of the limitations inherent in the use of the clapper allow a capability of much higher printing speed, while providing for greater control of the hammer's actions.

The hammer assembly is provided with a polyurethane cushion against which the armature strikes after the hammer rebounds from the impact against the printing element. This cushion absorbs substantially all of the momentum of the armature/hammer element, thereby effectively bringing the armature/hammer element to a complete stop almost immediately after impact against the printing element.

As a result of this innovative construction, the present invention is capable of producing high quality printing at very high speeds. For example, impact printers using the present invention achieve routine printing speeds of 45 characters per second and speeds of 50 to 60 characters per second are considered within the capability of the invention. Moreover, because hammer assemblies constructed in accordance with the present invention have fewer moving parts than the prior art hammer assemblies, reliability is substantially improved.

BRIEF DESCRIPTION OF THE DRAWINGS

FIG. 1 is a schematic view of the typical prior art hammer assembly;

FIG. 2 is a top plan view of the hammer assembly constructed in accordance with the present invention;

FIG. 3 is a cross-sectional view taken along line 3—3 of FIG. 2; and FIG. 4 is a perspective view of a hammer assembly of the present invention showing its position in a typical daisy wheel impact printer.

BRIEF DESCRIPTION OF THE INVENTION

The advantages of the present invention can best be appreciated by a thorough understanding of the typical prior art impact printer hammer assembly 10 as shown in FIG. 1. In the typical prior art hammer assembly, a clapper arm 12 mounted on a pivot 14 at one end carries a clapper 16 at the opposite end. Typically mounted on the clapper arm 12 somewhat above the pivot 14 is an iron armature 18.

A pair of electromagnet coils 20 and 21 are located close to the armature 18. The lower coil 20 is initially energized to start the clapper moving toward a hammer 22. As the armature 18 approaches the upper coil 21, the lower coil 20 is de-energized and the upper coil 21 is energized. This sequential actuation of the two coils 20 and 21 provides a relatively constant electromagnetic force so that the acceleration of the clapper 16 toward the hammer 22 is fairly constant. Finally, the clapper 16 strikes the hammer 22, the other end of which strikes a print element 24 so that a character is printed on a sheet 26 of paper when the print element presses the paper against a platen 28. A hammer return spring 34 returns the hammer 22 to its original position after it has struck the print element 24. A cushion element 36 is provided to absorb the rebound of the clapper 16.

From the above description with reference to FIG. 1, the previously described problems of the prior art hammer assembly system should be manifest.

The construction of the present invention is shown most clearly in FIGS. 2 and 3. A hammer assembly 40 constructed in accordance with the present invention comprises a hammer housing 42 typically of hard plastic. Attached to the rear of the hammer housing 42 as by one or more screws 44 is an iron frame 46 enclosing a solenoid coil 48. The hammer housing 42 is preferably provided with a pair of lateral flanges 50, each having an aperture 52 for accommodating screws (not shown) for fastening the assembly to a frame member or support in the printer. An end cap 54 is fastened to the solenoid frame 46 as by one or more screws 56.

The hammer housing 42 is a hollow, substantially tubular, open-ended member. The front of the housing 42 is closed by a hammer bearing member 62, preferably of plastic, which has an outer peripheral flange 64 which seats against the front end of the housing 42, being attached thereto by one or more screws 63. The hammer bearing 62 is provided with a central cylindrical hammer bore 66 to allow passage of a hammer or ram 68 therethrough. Toward the rear of the housing interior is a cylindrical spring locator 70, preferably of plastic. The spring locator 70 is longitudinally moveable within the housing interior and has a peripheral flange 72 around its posterior end. The spring locator flange 72 provides a seat for one end of a cylindrical hammer return spring 74 surrounding a substantial length of the ram 68 and sharing a common axis with the ram. The other end of the return spring 74 seats against a shoulder 76 on the hammer bearing 62. The ram or hammer 68 is fitted axially through the spring locator 70 and attached by a press fit so that the hammer 68 and the spring locator 70 travel through the housing 42 as a unit.

The hammer return spring 74 is provided with a short tang 77 at each end. The rearward tang 77 is embedded in the spring locator 70, while the forward tang 77 is embedded in the hammer bearing member 62. So disposed, the tangs 77 prevent rotation of the spring locator 70, and thus of the hammer or ram 68, for reasons to be shortly set forth.

The hammer or ram 68 comprises a hollow, hard anodized aluminum cylinder or tube having an open front end 78. The ram or hammer 68 has an integral armature connecting element 80 which is a tubular portion of reduced diameter. The open front end 78 of the hammer or ram 68 is closed by a striker element or anvil 84 which is of hard annodized aluminum. The anvil 84 is in the form of a plug fitted into the interior of the ram 68. The anvil 84 terminates in a flattened vertical striking element 86, in the form of a narrow bar of rectangular cross-section for impacting against a printing element.

The solenoid coil 48 surrounds a generally tubular pole piece 88 of pure low-reluctance iron. The armature connecting segment 80 of the ram 68 is slidingly journaled in a central axial bore through the pole piece 88. The armature connecting member 80 terminates in a tapered open end 90, which mates with a conical recess in the front of a solenoid armature 92, which is of pure, low-reluctance iron. The rear of the armature 92 is in the form of an open-ended tube having an interior surface 94 which in turn is provided with a cylindrical recess to accommodate the head of a screw 96 for fastening the armature 92 to the tapered terminal end 90 of the armature connecting member 80. Accordingly, the terminal end 90 is internally threaded to accommodate the screw 96. Fastened in this manner, the armature 92 and the ram or hammer 68 form a unitary armature/ram element, so that any movement of the armature is directly imparted to the ram or hammer.

The armature 92 has a leading surface 98 which is tapered at an angle of approximately 40 degrees to form a truncated right frusticonical section. This armature leading surface 98 faces a conforming conically recessed surface 100 in the pole piece 88, surfaces 98 and 100 being essentially parallel to one another. This configuration of the surfaces 98 and 100 allows the lines of magnetic force set up between the pole piece 88 and the armature 92 when the coil 48 is energized to be essentially parallel to one another. With the lines of magnetic force being parallel, the strength of the magnetic force between the armature 92 and the pole piece 88 will remain substantially constant as the armature is pulled toward the pole piece 88 by the magnetic attraction. This constant force, in turn, results in a constant acceleration being imparted to the armature 92, which acceleration, of course is transmitted directly to the ram 68. Thus, the present invention achieves a constant acceleration of the hammer mechanism using only a single coil, as opposed to the double coils of the prior art. Moreover, the direct linkage between the armature 92 and the ram or hammer 68 allows for a very precise control of the speed and therefore, the force of impact of the striking element 86 against a print element. Furthermore, the configuration of the pole piece 88 and the armature 92, in providing for substantially parallel lines of magnetic force and thus a substantially uniform force field, allows for a long hammer stroke using a single, relatively small coil.

To facilitate the axial movement of the armature 92, the armature is journaled in a bushing 102 of polyphenyline sulfide resin. This material has a high degree of lubricity, while being capable of withstanding relatively high temperatures. To absorb the energy of the armature/hammer unit as it rebounds after impact with the print element, a polyurethane cushion 104 is fitted into the end cap 54. The cushion 104 is maintained in place by a plastic washer 106.

Having fully described the structure of the hammer assembly of the present invention, its manner of operation will be more easily understood. As shown in FIG. 4, the hammer assembly 40 of the present invention is located adjacent a print wheel or daisy wheel 110, having a plurality of petal-like print elements 112, each bearing a print character (not shown).

With the hammer or ram 68 in its withdrawn position, i.e., as it is shown in FIG. 3, the striking element 86 is spaced a short distance from the daisy wheel 110 so that the daisy wheel may be freely rotated to place the desired printing element 112 in position in front of the hammer. As previously mentioned, the striking element 86 is in the form of a narrow, vertical bar of rectangular cross section. This shape is due to the fact that the printing elements 112 are very narrow and spaced very close together. Accordingly, means must be provided for maintaining the striking member 86 in a vertical orientation so as not to strike more than one printing element. Such means are provided by the previously described tangs 77 of the spring 74 which are embedded in the spring locator 70 and the hammer bearing 62 to prevent rotation of the ram 68.

When the coil 48 is energized, a magnetic field is set up between the pole piece 80 and the armature 92. The armature is propelled toward the pole piece with a constant acceleration as previously described. It has been found that by energizing the coil 48 with a source using constant current rather than constant voltage, the effects of increased resistance of the coil winding due to the generation of heat can be compensated for, thereby contributing to the constancy of the magnetic field within the solenoid, since field strength is a function of the current in the windings.

As the armature 92 is pulled toward the pole piece, 80 by the magnetic field, the ram 68 is likewise pulled toward the print element 112. The ram 68 pulls the spring locator 70 forward along with it, thereby compressing the hammer return spring 74. The dimensions of the ram armature and pole piece and the spacing between the striking member 56 and the print element 112 are such that the striking element strikes the print element before the armature leading surface 98 comes into contact with the pole piece surface 100, thereby ensuring that contact is never made between these two surfaces. The striking of a print element 112 by the striking element 86 drives the print element against a ribbon 113 situated in front of a sheet 114 of paper to be printed, pressing the ribbon and paper against a platen 116, thereby printing a character on the paper. After the striking element strikes the print element, the hammer return spring 74 acting against the flange 72 of the spring locator 70 pulls the ram back into its withdrawn position. The rebounding armature strikes the polyurethane cushion 104, which in turn absorbs substantially all of the energy of the armature/hammer unit, so as to bring the motion of this unit to an almost immediate stop, thereby making the hammer very quickly ready for the next stroke. As the hammer withdraws, the print wheel 110 rotates to bring the next desired print element 112 into position for printing.

Another significant advantage in operation is achieved because of the constancy of the magnetic field strength between the armature and the pole piece, due to the configuration of these elements. This advantage is that by controlling the strength of the magnetic field through adjustment of the current through the coil 48, after the impact between the striking element 86 and the print element 112, the rebound of the hammer may be much more precsely controlled than through the use of the spring 74 alone. Thus, for example, by allowing the coil current to decay through an appropriately selected RC time constant, the armature/ram unit may be very quickly and precisely decelerated so that the cushion 104 is struck only lightly, thereby ensuring that the motion of the armature/hammer unit is brought to almost an instantaneous halt. This is a significant improvement over the prior art in which a cushion alone is relied on to bring the hammer to a half, inasmuch as in the prior art hammer assemblies, the magnetic field is switched off at about the time the hammer strikes the print element. Thus, in the present invention, the solenoid coil, pole piece, and armature constitute momentum absorbing, or damping, means for the hammer, which, in conjunction with the cushion 104, greatly reduces the time needed for stopping the motion of the hammer, so that the hammer is more quickly ready for the next stroke, thereby increasing the printing speed capability of the printer.

I claim:

1. A hammer assembly for a high speed impact printer, comprising:

a solenoid having a coil and an axially apertured pole piece, said pole piece having a conically shaped recessed surface;

an axially movable armature within said solenoid, said armature having a tapered conical leading surface substantially parallel to the recessed surface of said pole piece, said parallel conical surfaces producing a constant magnetic field characterized by parallel lines of force of uniform density, said coil being energized by a constant current whereby the constancy of said magnetic field is enhanced, said armature being propelled toward said pole piece by the magnetic attraction of said constant field when said coil is energized by said constant current; and hammer means rigidly connected to said armature to form a unitized armature/hammer element, for striking a print element in said printer, said hammer means being uniformly accelerated due to said constant field and axially moved a substantially long distance through said pole piece armature by the movement of said armature.

2. The hammer assembly of claim 1, further comprising:

electrical means for absorbing the momentum of said armature/hammer element when said unit rebounds after impact with said print element so that said armature/hammer element is brought to a substantially immediate stop after rebounding due to the controlled decay of said magnetic field acting on said armature/hammer element.

3. The hammer assembly of claim 2, wherein said momentum absorbing means comprises:

said solenoid; and said armature, wherein after said armature/hammer element impacts said print element, said current to said coil of said solenoid is selectively decreased by an appropriate RC time constant.

4. The hammer assembly of claim 1, further comprising:

means for preventing the rotation of said hammer means.

5. The hammer assembly of claim 4, wherein said rotation-preventing means comprises:

a housing;

a bearing member rigidly attached to said housing and having an aperture through which said hammer means is axially moveable;

a cylindrical spring within said housing and surrounding a substantial portion of the length of said hammer means, one end of said spring being attached to said bearing member; and a spring locator element attached around the periphery of said hammer means and attached to the other end of said spring.

6. A hammer assembly for a high speed impact printer; comprising:

a solenoid having a coil and a pole piece, said pole piece having a conically-recessed surface;

an armature in said solenoid having a conical surface facing and substantially parallel to said conical pole piece surface, said armature being propelled toward said pole piece by magnetic attraction when said coil is energized by a constant current;

hammer means, rigidly connected to said armature, for striking a print element in said printer when said armature is propelled toward said pole piece; and said parallel conical surfaces on said armature and said pole piece and said constant current producing a magnetic force of substantially constant magnetic between said pole piece and said armature as said armature moves toward said pole piece, so that said armature and said hammer means move with a substantially constant acceleration through a substantially long distance.

7. The hammer assembly of claim 6, wherein said magnetic force produces a magnetic field having substantially parallel lines of force.

8. The hammer assembly of claim 6, wherein said solenoid and said armature comprise momentum-absorbing means for stopping said hammer means as it rebounds after striking said print element.

9. A hammer assembly for a high speed impact printer, comprising:

first means for producing a magnetic field;

second means for striking a print element in said printer; and third means responsive to said magnetic field, for both (a) driving said second means toward said print element with substantially constant acceleration, and (b) controllably decelerating said second means as it rebounds after striking said print element.

10. The hammer assembly of claim 9, wherein said first means comprises a solenoid having a coil and a pole piece, and said third means comprises:

an armature connected to said second means and having a leading surface facing, and substantially parallel to, a conforming surface on said pole piece, the configuration of said pole piece surface and said armature surface producing a magnetic force of substantially constant magnitude on said armature as said armature approaches said pole piece in response to said magnetic force.

* * * * *